US008922295B2

(12) United States Patent
Haruna

(10) Patent No.: US 8,922,295 B2
(45) Date of Patent: Dec. 30, 2014

(54) DIRECTIONAL COUPLER

(75) Inventor: Takao Haruna, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 517 days.

(21) Appl. No.: 13/115,166

(22) Filed: May 25, 2011

(65) Prior Publication Data

US 2012/0119846 A1 May 17, 2012

(30) Foreign Application Priority Data

Nov. 12, 2010 (JP) ..... 2010-253884

(51) Int. Cl.
*H01P 5/18* (2006.01)
*H01P 3/08* (2006.01)

(52) U.S. Cl.
USPC ..... 333/116; 333/109

(58) Field of Classification Search
USPC ..... 333/109, 110, 111, 112, 116, 118, 238
See application file for complete search history.

(56) References Cited

U.S. PATENT DOCUMENTS

| | | | | |
|---|---|---|---|---|
| 6,683,512 | B2 * | 1/2004 | Nakamata et al. | 333/126 |
| 6,894,578 | B1 * | 5/2005 | Kishimoto et al. | 333/1.1 |
| 7,394,333 | B2 * | 7/2008 | Ezzeddine et al. | 333/109 |
| 2002/0196085 | A1 | 12/2002 | Nakamata et al. | |

FOREIGN PATENT DOCUMENTS

| | | | |
|---|---|---|---|
| JP | 10-290108 | A | 10/1998 |
| JP | 2000-278168 | A | 10/2000 |
| JP | 2001-94315 | A | 4/2001 |
| JP | 2002-299922 | A | 10/2002 |
| JP | 2004-289797 | A | 10/2004 |
| JP | 2004-320408 | A | 11/2004 |
| JP | 2005-117497 | A | 4/2005 |

OTHER PUBLICATIONS

Korean Patent Office, Office Action in Korean Patent Application No. 10-2011-0113709 (Apr. 1, 2013).

Korean Patent Office, Office Action in Korean Patent Application No. 10-2011-0113709 (Sep. 1, 2013).

State Intellectual Property Office Of the People's Republic of China, Office Action in Chinese Patent Application No. 201110246595.5 (Nov. 13, 2013).

Japanese Patent Office; Office Action in Japanese Patent Application No. 2010-253884 (Mar. 4, 2014).

State Intellectual Property Office of the People's Republic of China; Office Action in Chinese Patent Application No. 201110246595.5 (Mar. 27, 2014).

Taiwanese Patent Office; Office Action in corresponding Taiwanese Patent Application (Sep. 4, 2014).

* cited by examiner

*Primary Examiner* — Dean O Takaoka
(74) *Attorney, Agent, or Firm* — Leydig, Voit & Mayer, Ltd.

(57) ABSTRACT

A directional coupler includes: a main strip line connected between a first input terminal and a first output terminal and transmitting high-frequency signals; a sub strip line connected between a second input terminal and a second output terminal, located parallel to the main strip line, and electromagnetically coupled to the main strip line; and a first capacitor connected in parallel with the main strip line or the sub strip line, wherein an LC resonant circuit is constituted by inductances of the main strip line and sub strip line and capacitance of the first capacitor, and the LC resonant circuit resonates with respect to a high-frequency signal propagating from the first input terminal to the second output terminal.

3 Claims, 14 Drawing Sheets

DIRECTIONAL COUPLER

BACKGROUND OF THE INVENTION

1. Field of the Invention

The present invention relates to a directional coupler which is equipped with a main strip line transmitting high-frequency signals, and a sub strip line located in parallel to the main strip line and electromagnetically connected to the main strip line.

2. Background Art

A directional coupler is equipped with a main strip line transmitting high-frequency signals, and a sub strip line located in parallel to the main strip line and electromagnetically connected to the main strip line. The directional coupler uses the electromagnetic connection of the main strip line and the sub strip line to output a part of the high-frequency signals inputted from each terminal of the main strip line to each terminal of the sub strip line.

In the main strip line and the sub strip line, the transmission of high-frequency signals known as even mode or odd mode occurs. The even mode is the case wherein the main strip line and the sub strip line are excited in the identical potential, which is the in-phase equal amplitude. The odd mode is the case wherein the main strip line and the sub strip line are excited in the reverse potential, which is the reversed-phase equal amplitude. The impedance of each mode is determined by the cross-sectional shape of the line.

When the characteristic impedance in the even mode is denoted by $Z0e$, and the characteristic impedance in the odd mode is denoted by $Z0o$, the characteristic impedance $Z0$ of the main strip line and the sub strip line is given by $Z0=(Z0e \cdot Z0o)^{1/2}$.

By equalizing the phase velocity of each mode, and making the lengths of the main strip line and the sub strip line one-quarter of the wavelength of high-frequency signals, the high-frequency signals inputted from the input terminal of the main strip line appear only at the output terminal of the sub strip line, and favorable isolation characteristics can be obtained. For example, in the case of high-frequency signals of 2.5 GHz, the line length becomes about 30 mm.

A directional coupler attempted loss lowering by connecting the capacitor in parallel to the main strip line, constituting the LC resonating circuit with the main strip line and the capacitor, and resonating the high-frequency signals transmitted to the output terminal of the main strip line from the input terminal of the main strip line, has been proposed (for example, refer to Japanese Patent Application Laid-Open No. 10-290108).

SUMMARY OF THE INVENTION

The coupling degree k of the main strip line and the sub strip line if given by the equation $k=(Z0e-Z0o)/(Z0e+Z0o)$. Therefore, for elevating the coupling degree, it is required to lower the characteristic impedance $Z0o$ in the odd mode. For this purpose, capacitance (coupling capacity) for a unit length between the coupling lines must be elevated. However, if the line distance is narrowed for elevating the coupling degree, difference between respective phase velocities in even and odd modes occurs, and the directionality is deteriorated. On the other hand, since the line distance cannot be much narrowed under the condition wherein differences between respective phase velocities between even and odd modes are reduced, the high coupling degree cannot be obtained.

In view of the above-described problems, an object of the present invention is to provide a directional coupler having a high degree of coupling and a favorable directivity.

According to the present invention, a directional coupler includes: a main strip line connected between a first input terminal and a first output terminal and transmitting high-frequency signal; a sub strip line connected between a second input terminal and a second output terminal, located in parallel to the main strip line, and electromagnetically connected to the main strip line 1; and a first capacitor connected in parallel to the main strip line or the sub strip line, wherein an LC resonant circuit is constituted by the inductance of the main strip line and the sub strip line and the capacitance of the first capacitor, and the LC resonant circuit resonates with respect to high-frequency signal propagating from the first input terminal to the second output terminal.

The present invention makes it possible to provide a directional coupler having a high degree of coupling and a favorable directivity.

Other and further objects, features and advantages of the invention will appear more fully from the following description.

DETAILED DESCRIPTION OF THE PREFERRED EMBODIMENTS

A directional coupler according to the embodiments of the present invention will be described with reference to the drawings. The same components will be denoted by the same symbols, and the repeated description thereof may be omitted.

First Embodiment

Figure 1:
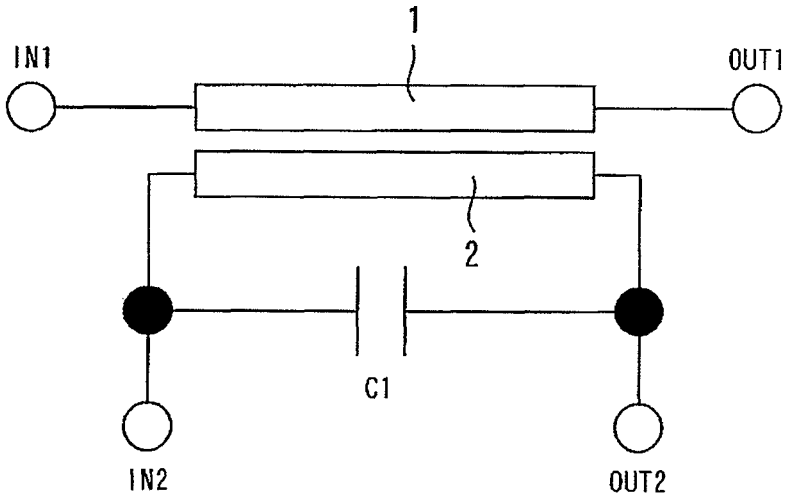
FIG. 1 is a diagram showing a directional coupler according to the first embodiment of the present invention.

FIG. 1 is a diagram showing a directional coupler according to the first embodiment of the present invention. A main strip line 1 is connected between an input terminal IN1 and an output terminal OUT1. The main strip line 1 transmits high-frequency signals. A sub strip line 2 is connected between an input terminal IN2 and an output terminal OUT2. The sub strip line 2 is located in parallel to the main strip line 1, and is electromagnetically connected to the main strip line 1.

In the present embodiment, a capacitor C1 is connected in parallel to the sub strip line 2. An LC resonant circuit is constituted by the inductance L of the main strip line 1 and the sub strip line 2 and the capacitance C of the capacitor C1. This LC resonant circuit resonates with respect to the propagating high-frequency signals from the input terminal IN1 to the output terminal OUT2. When the frequency of the propagating high-frequency signals from the input terminal IN1 to the output terminal OUT2 is denoted by f, the capacitance C is set to the value that satisfies the relation of the LC resonance, $f=\frac{1}{2}\pi(LC)^{1/2}$. The Q value representing the sharpness of the resonation peak of the LC resonant circuit is given by $Q=(L/C)^{1/2}/R$ using the resistance R, the inductance L, and the capacitance C of the LC resonant circuit.

Figure 2:
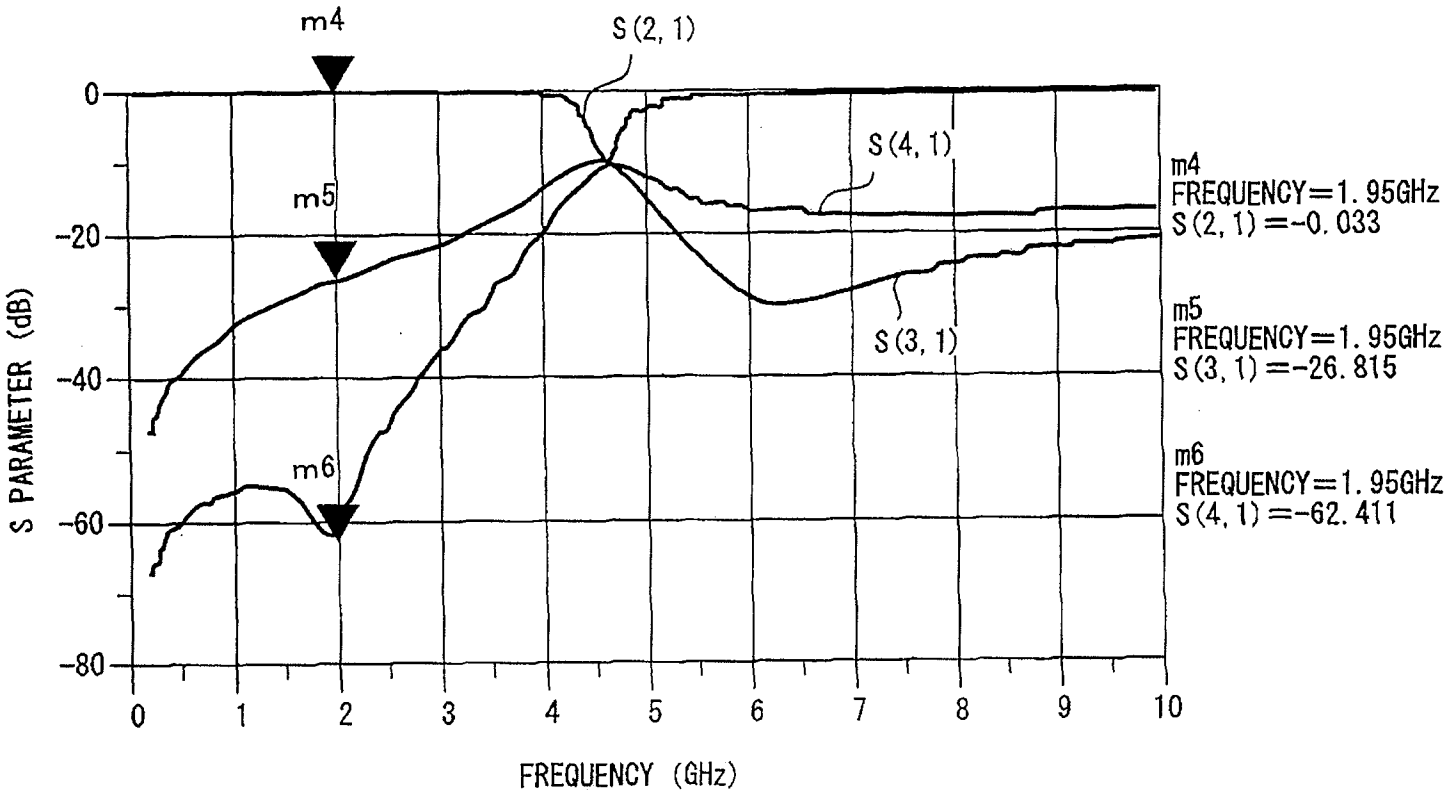
FIG. 2 is a graph showing the calculation result of the S parameter of the directional coupler according to the first embodiment of the present invention.

FIG. 2 is a graph showing the calculation result of the S parameter of the directional coupler according to the first embodiment of the present invention. The line S (2, 1) denotes high-frequency signals transmitting the main strip line 1, and the frequency thereof is about 4.5 GHz. The line S (4, 1) denotes high-frequency signals transmitted to the output terminal OUT2 of the sub strip line 2, from the input terminal IN1 of the main strip line 1, and the frequency thereof is about 2 GHz. Therefore, in the present embodiment, the capacitance C is set so that the LC resonant circuit resonated at the frequency of about 2 GHz.

Figure 3:
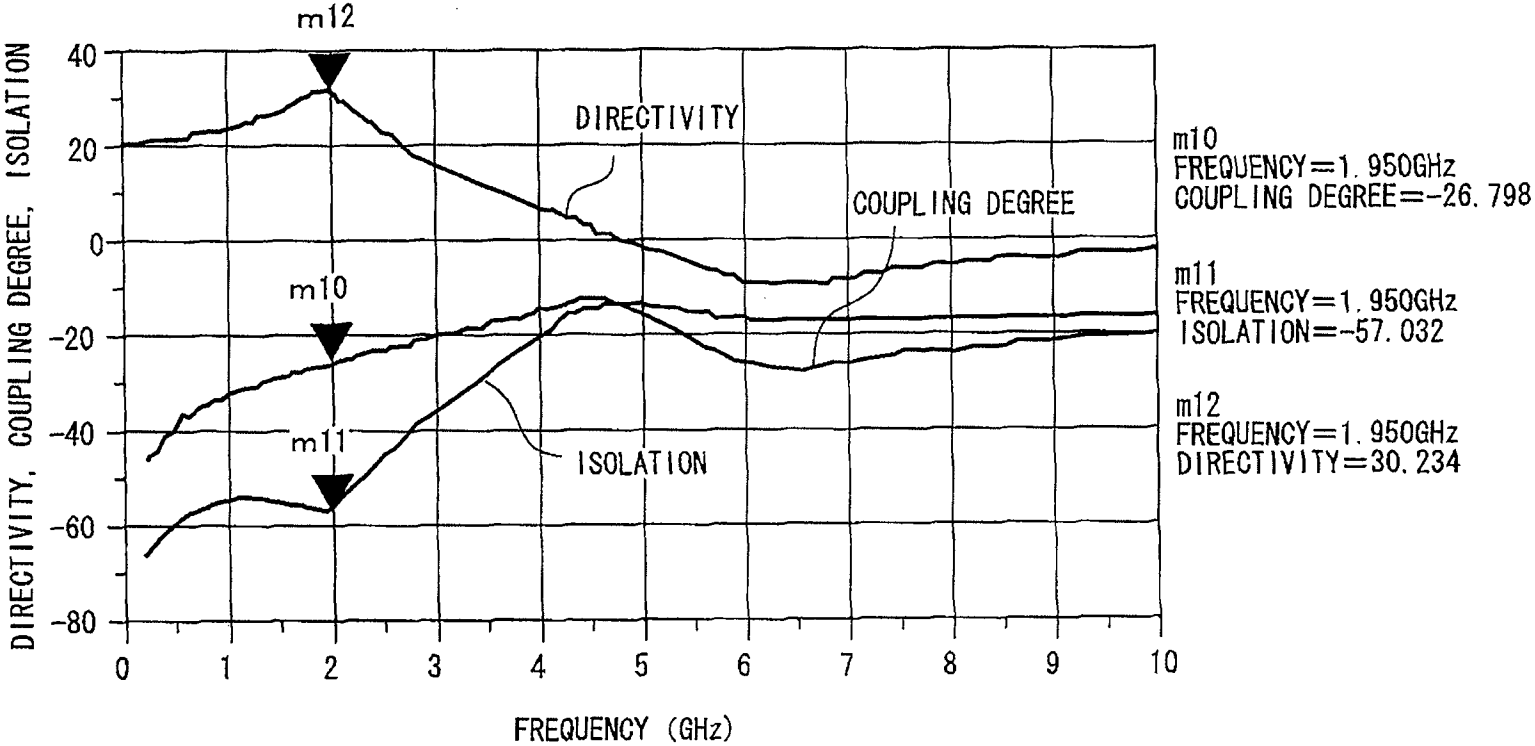
FIG. 3 is a graph showing the calculation result of the directivity of the directional coupler according to the first embodiment of the present invention.
Figure 4:
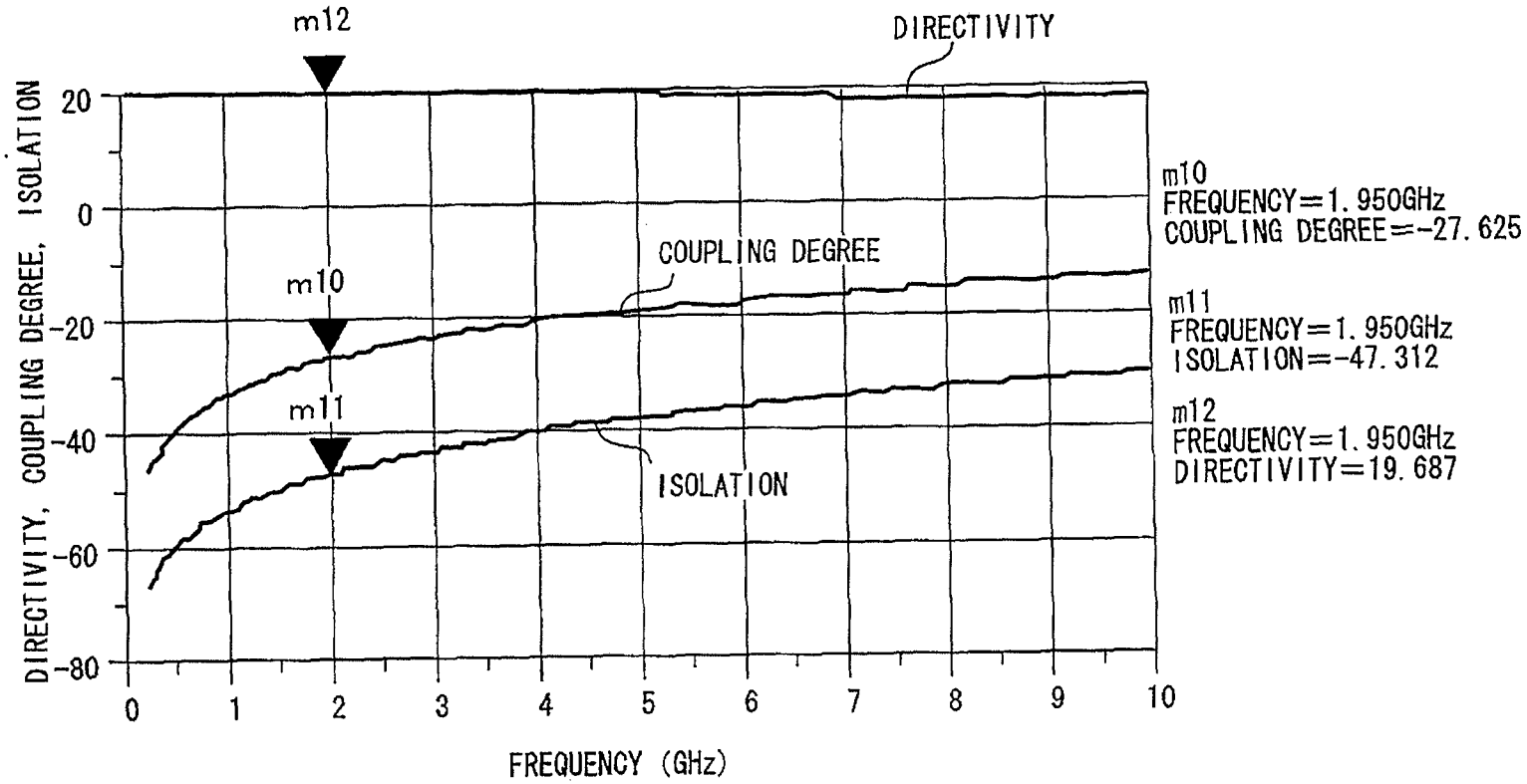
FIG. 4 is a graph showing the calculation result of the directivity of the directional coupler according to the comparative example.

Next, the effect of the present embodiment will be described in comparison with a comparative example. The comparative example is an example wherein the capacitor C1 is omitted from the constitution of the present embodiment. FIG. 3 is a graph showing the calculation result of the directivity of the directional coupler according to the first embodiment of the present invention. FIG. 4 is a graph showing the calculation result of the directivity of the directional coupler according to the comparative example. The ordinate represents directivity, the coupling degree, and isolation; and the abscissa represents frequency. From this calculation result, in the first embodiment, it is known that the directivity is improved in the frequency rage from 1.1 GHz to 2.4 GHz centering at the frequency of 1.95 GHz in comparison with the comparative example.

In the comparative example, if the line distance is narrowed for elevating the degree of coupling, difference occurs in the respective phase velocities in the even and odd modes, and the directivity is deteriorated. Whereas in the present embodiment, by forming the capacitor C1 and setting the capacitance C so as to satisfy the above-described resonating conditions, a high degree of coupling as well as a favorable directivity can be obtained.

Here, since the phase velocity depends on L and C (proportional to $1/(LC)^{1/2}$), the phase velocity can be adjusted by varying L and C. Then, in the frequency wherein the directivity is improved, it is estimated that the phase velocities of the even and odd modes are agreed. Therefore in the present embodiment, it is considered that difference in the phase velocities of even and odd modes can be compensated by LC resonation.

Figure 5:
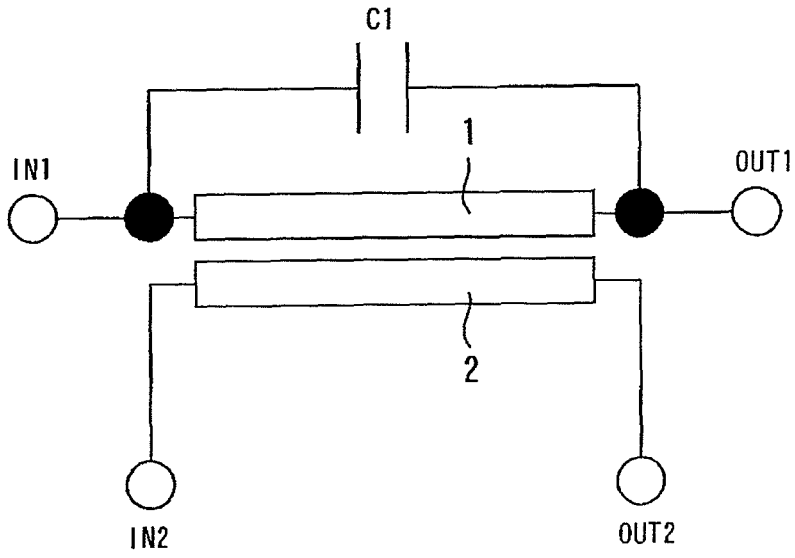
FIG. 5 is a diagram showing a first modified example of the directional coupler according to the first embodiment of the present invention.

FIG. 5 is a diagram showing a first modified example of the directional coupler according to the first embodiment of the present invention. It is different from the first embodiment in that the capacitor C1 is connected in parallel to the main strip line 1. Also in this case, the equal effect as in the first embodiment can be obtained as long as the conditions wherein the LC resonant circuit resonates by the high-frequency signals transmitted from the input terminal IN1 to the output terminal OUT2 are satisfied.

Figure 6:
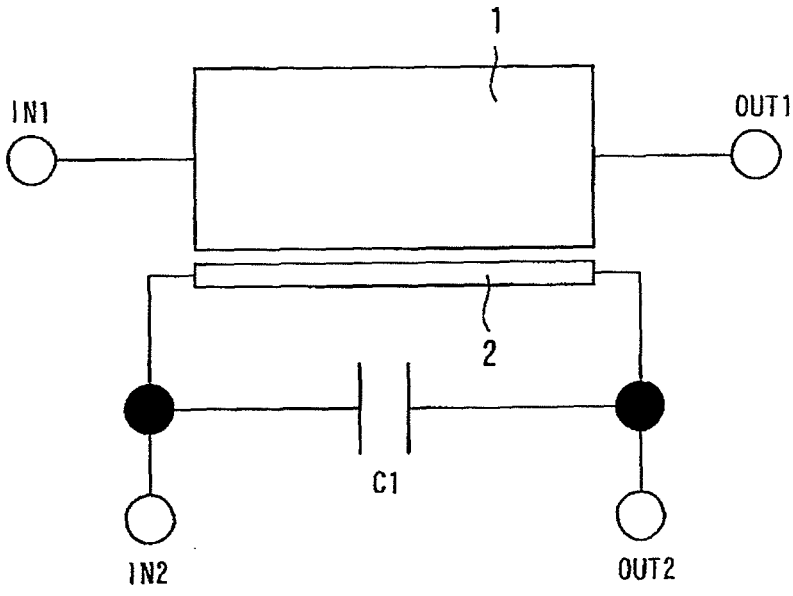
FIG. 6 is a diagram showing a second modified example of the directional coupler according to the first embodiment of the present invention.

FIG. 6 is a diagram showing a second modified example of the directional coupler according to the first embodiment of the present invention. The width of the sub strip line 2 is narrowed than the width of the main strip line 1. Thereby, the size of the directional coupler can be reduced. Also if the main strip line 1 is narrowed, although the loss of the main strip line 1 elevates, in the second modified example, the loss of the main strip line 1 is not elevated.

Figure 7:
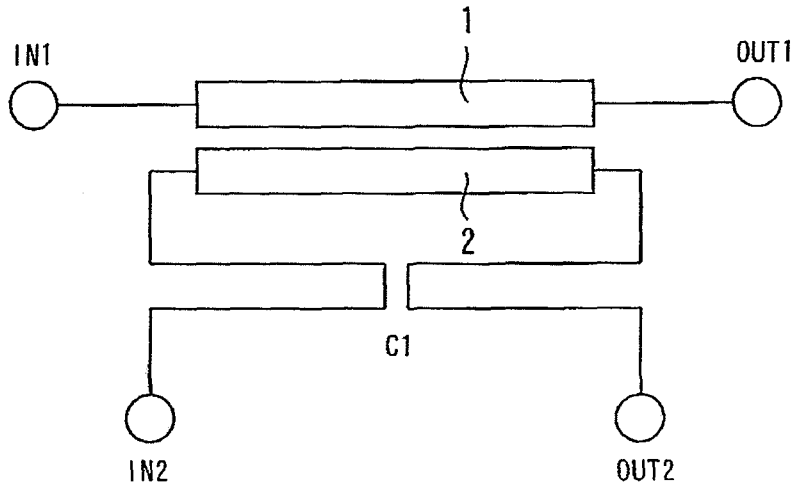
FIG. 7 is a diagram showing a third modified example of the directional coupler according to the first embodiment of the present invention.

FIG. 7 is a diagram showing a third modified example of the directional coupler according to the first embodiment of the present invention. Even if the capacitor C1 with such a narrow line distance is constituted, the identical effect can be obtained.

Also if a MIM (Metal-Insulator-Metal) capacitor is used as the capacitor C1, the identical effect can be obtained. In this case, an inductor connected to the capacitor C1 in series can be added for reducing the size of the MIM capacitor.

Second Embodiment

Figure 8:
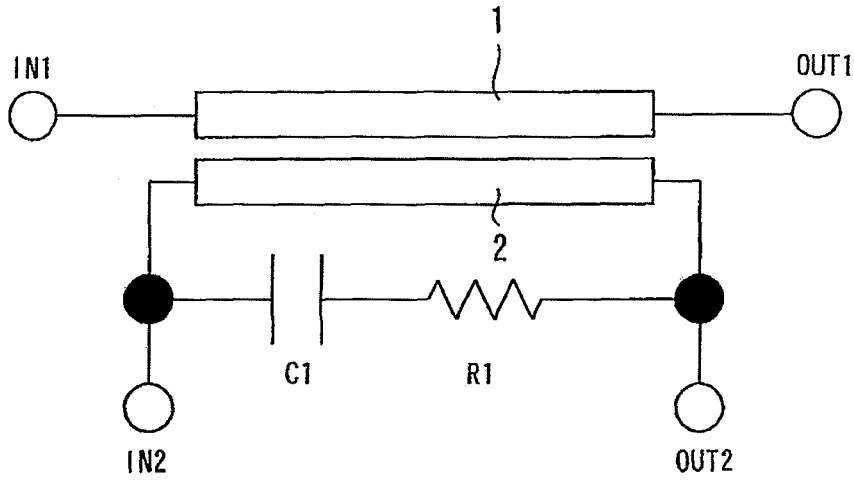
FIG. 8 is a diagram showing a directional coupler according to the second embodiment of the present invention.

FIG. 8 is a diagram showing a directional coupler according to the second embodiment of the present invention. The resistance R1 connected to the capacitor C1 in series is added to the constitution of the modified example 1 of the first embodiment. Thereby, the Q value can be decreased to blunt the peak of the LC resonance of the directional coupler and the capacitor C1. Therefore, the frequency range of the improved directivity, can be widened in comparison with the first embodiment.

Figure 9:
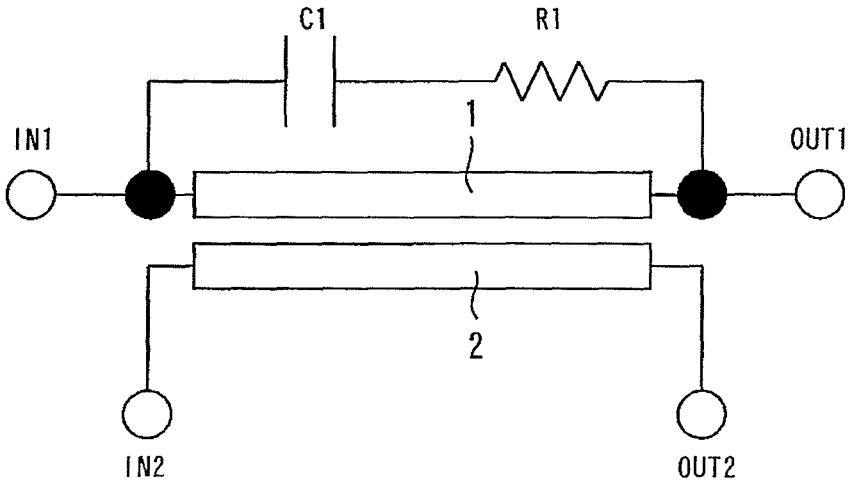
FIG. 9 is a diagram showing a modified example of the directional coupler according to the second embodiment of the present invention.

FIG. 9 is a diagram showing a modified example of the directional coupler according to the second embodiment of the present invention. The resistance R1 connected to the capacitor C1 in series is added to the constitution of the modified example 1 of the first embodiment. Thereby, the identical effect as the effect of the second embodiment can be obtained.

Third Embodiment

Figure 10:
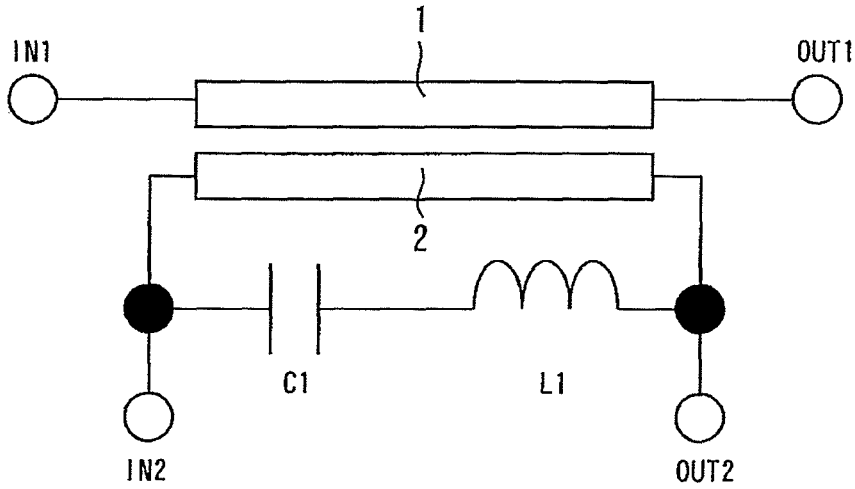
FIG. 10 is a diagram showing a directional coupler according to the third embodiment of the present invention.

FIG. 10 is a diagram showing a directional coupler according to the third embodiment of the present invention. The inductor L1 connected to the capacitor C1 in series is added to the constitution of the first embodiment is added. Thereby, the Q value can be enlarged, and the peak of the LC resonance of the directional coupler and the capacitor C1 can be sharpened. Therefore, the absolute value of the directivity to be improved in a narrow frequency range can be enlarged in comparison with the first embodiment. Furthermore, the capacitance of the capacitor C1 can be reduced in comparison with the first embodiment.

Figure 11:
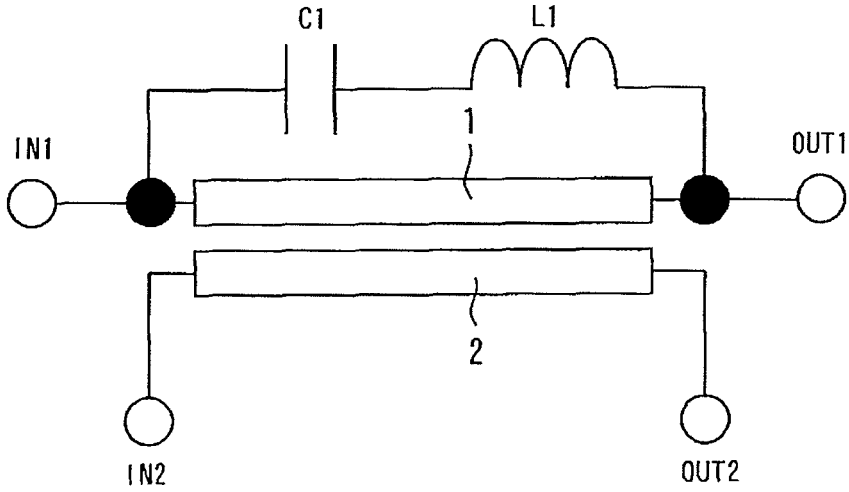
FIG. 11 is a diagram showing a modified example of the directional coupler according to the third embodiment of the present invention.

FIG. 11 is a diagram showing a modified example of the directional coupler according to the third embodiment of the present invention. The inductor L1 connected to the capacitor C1 in series is added to the constitution of the first modified example of the first embodiment is added. Thereby, the identical effect as the effect of the third embodiment can be obtained.

Fourth Embodiment

Figure 12:
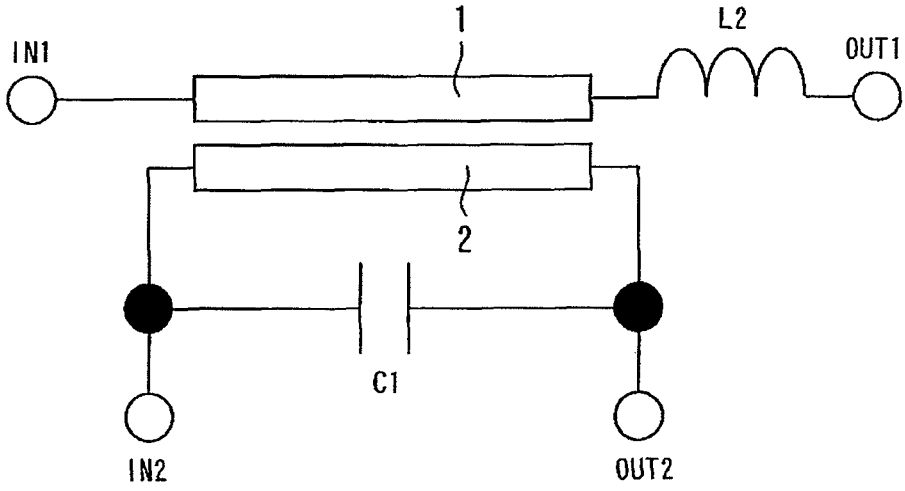
FIG. 12 is a diagram showing a directional coupler according to the fourth embodiment of the present invention.

FIG. 12 is a diagram showing a directional coupler according to the fourth embodiment of the present invention. The inductor L2 connected to the main strip line 1 in series is added to the constitution of the first embodiment. Thereby, the inductance of the directional coupler can be varied. Therefore, the center value, the frequency range, and the sharpness of the peak of resonance can be further adjusted in comparison with the first embodiment.

Figure 13:
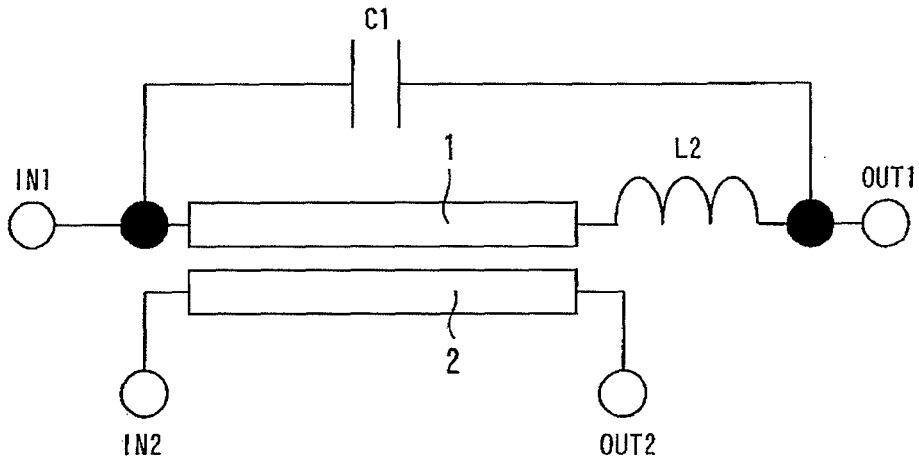
FIG. 13 is a diagram showing a modified example of the directional coupler according to the fourth embodiment of the present invention.

FIG. 13 is a diagram showing a modified example of the directional coupler according to the fourth embodiment of the present invention. The inductor L2 and connected to the main strip line 1 in series are added to the constitution of the first modified example of the first embodiment. Thereby, the identical effect as the effect of the fourth embodiment can be obtained.

Fifth Embodiment

Figure 14:
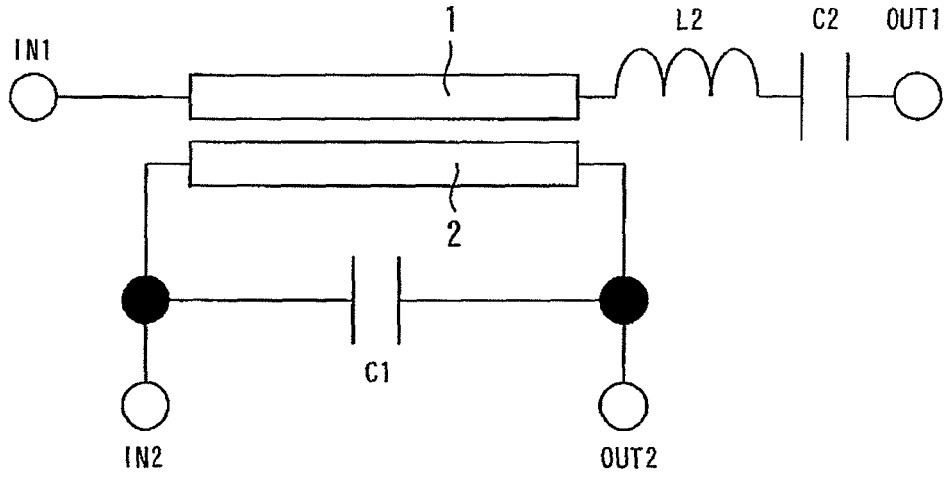
FIG. 14 is a diagram showing a directional coupler according to the fifth embodiment of the present invention.

FIG. 14 is a diagram showing a directional coupler according to the fifth embodiment of the present invention. The inductor L2 and the capacitor C2 connected to the main strip line 1 in series are added to the constitution of the first embodiment. Thereby, the inductance and the capacitance of the directional coupler can be varied. Therefore, the center value, the frequency range, and the sharpness of the peak of resonance can be adjusted in comparison with the first embodiment.

Figure 15:
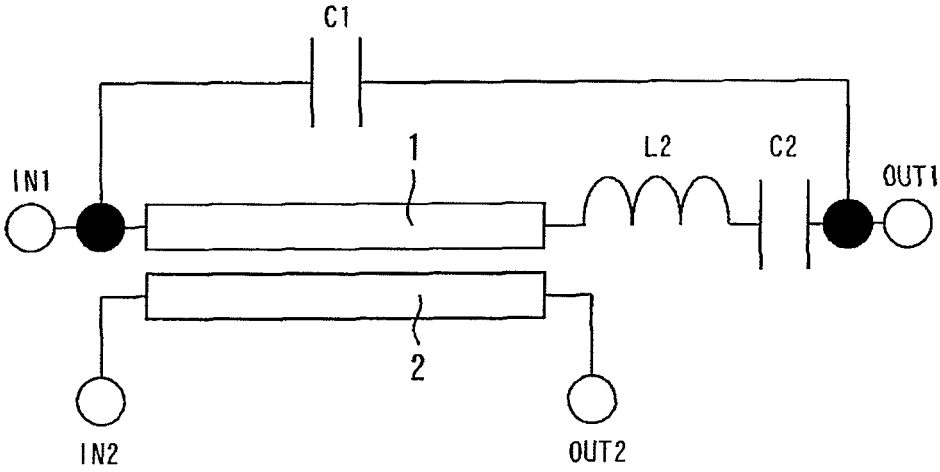
FIG. 15 is a diagram showing a modified example of the directional coupler according to the fifth embodiment of the present invention.

FIG. 15 is a diagram showing a modified example of the directional coupler according to the fifth embodiment of the present invention. The inductor L2 and the capacitor C2 connected to the main strip line 1 in series are added to the constitution of the first modified example of the first embodiment. Thereby, the identical effect as the effect of the fifth embodiment can be obtained.

Sixth Embodiment

Figure 16:
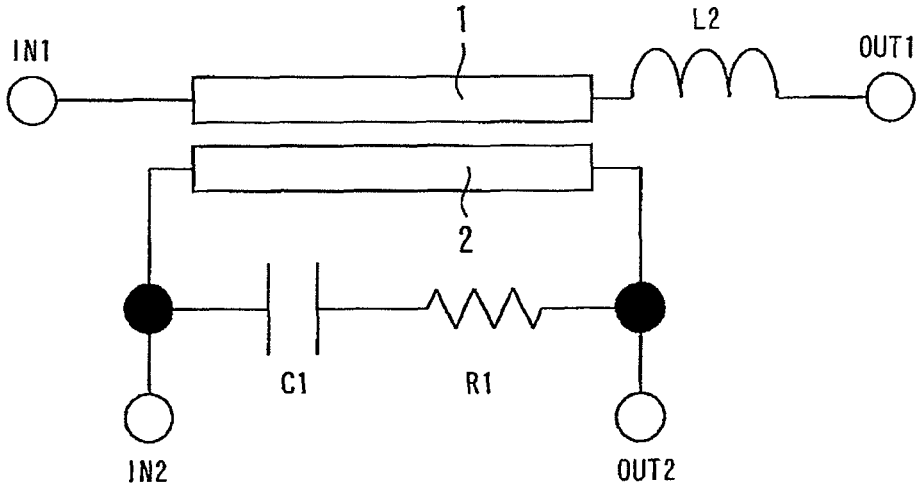
FIG. 16 is a diagram showing a directional coupler according to the sixth embodiment of the present invention.

FIG. 16 is a diagram showing a directional coupler according to the sixth embodiment of the present invention. The inductor L2 of the fourth embodiment is added to the constitution of the second embodiment. Thereby, the effects of the second embodiment and the fourth embodiment can be obtained. Specifically, the directional frequency range can be widened while adjusting the Q value by varying the inductance of the directional coupler.

For example, since the Q value is required to be enlarged when the absolute value of the directivity is to be improved within a narrow frequency range, the capacitance is reduced, the inductance is enlarged, and the resistance value is reduced. On the other hand, since the Q value is required to be reduced when the directivity is to be improved within a wide frequency range, the opposite adjustments are performed. However, it is required that the center value of the resonant frequency of the LC resonant circuit is equal to the center value of the frequency to improve the directivity.

Figure 17:
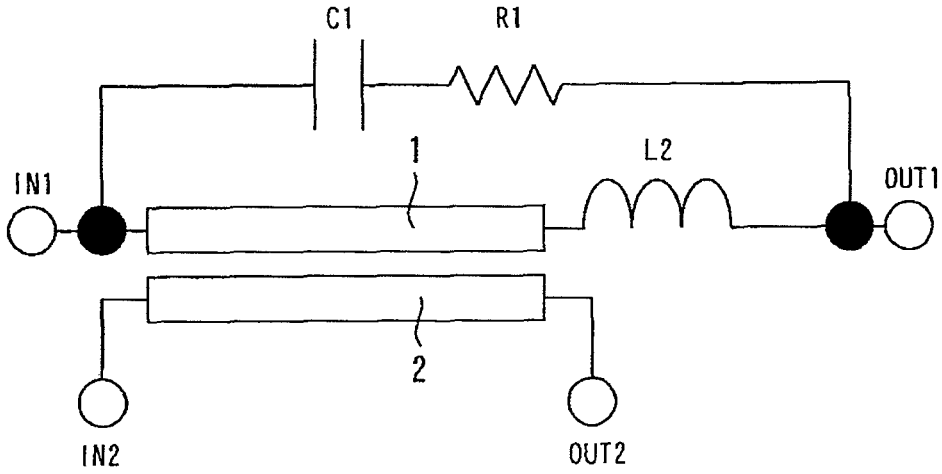
FIG. 17 is a diagram showing a modified example of the directional coupler according to the sixth embodiment of the present invention.

FIG. 17 is a diagram showing a modified example of the directional coupler according to the sixth embodiment of the present invention. The inductor L2 of the fourth embodiment is added to the constitution of the modified example of the second embodiment. Thereby, the effect identical as to the effect of the modified example of the third embodiment and the effect of the fourth embodiment can be obtained.

Seventh Embodiment

Figure 18:
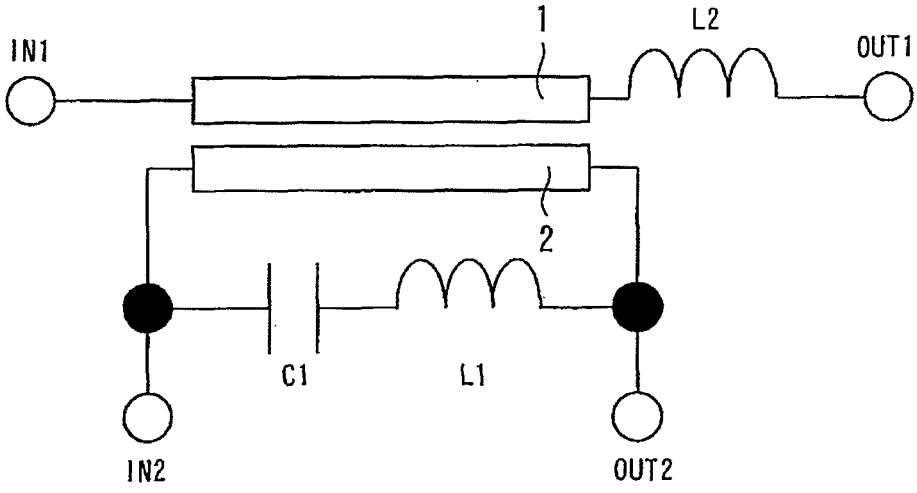
FIG. 18 is a diagram showing a directional coupler according to the seventh embodiment of the present invention.

FIG. 18 is a diagram showing a directional coupler according to the seventh embodiment of the present invention. The inductor L2 of the fourth embodiment is added to the constitution of the third embodiment. Thereby, the effect identical to the effect of the third embodiment and the fourth embodiment can be obtained.

Figure 19:
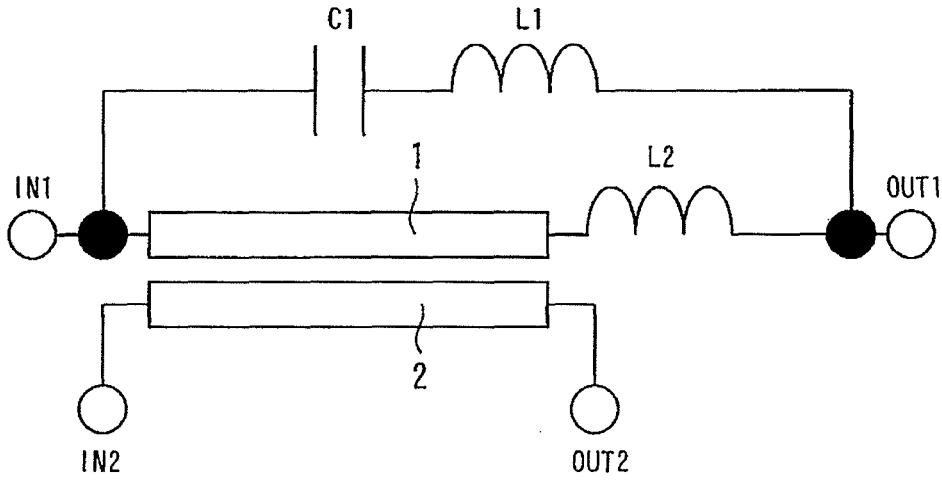
FIG. 19 is a diagram showing a modified example of the directional coupler according to the seventh embodiment of the present invention.

FIG. 19 is a diagram showing a modified example of the directional coupler according to the seventh embodiment of the present invention. The inductor L2 of the fourth embodiment is added to the constitution of the modified example of the third embodiment. Thereby, the effect identical to the effect of the modified example of the third embodiment and the effect of the fourth embodiment can be obtained.

Eighth Embodiment

Figure 20:
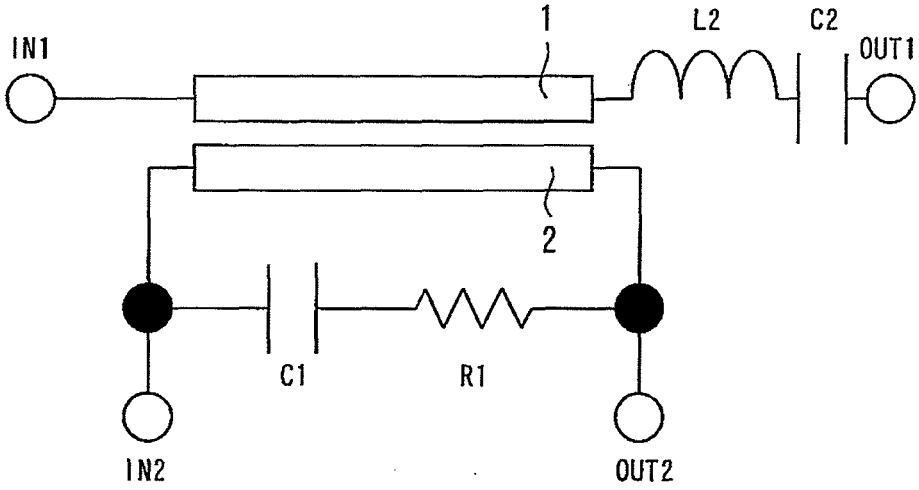
FIG. 20 is a diagram showing a directional coupler according to the eighth embodiment of the present invention.

FIG. 20 is a diagram showing a directional coupler according to the eighth embodiment of the present invention. The inductor L2 and the capacitor C2 of the fifth embodiment are added to the constitution of the second embodiment. Thereby, the effect identical to the effect of the second embodiment and the effect of the fifth embodiment can be obtained.

Figure 21:
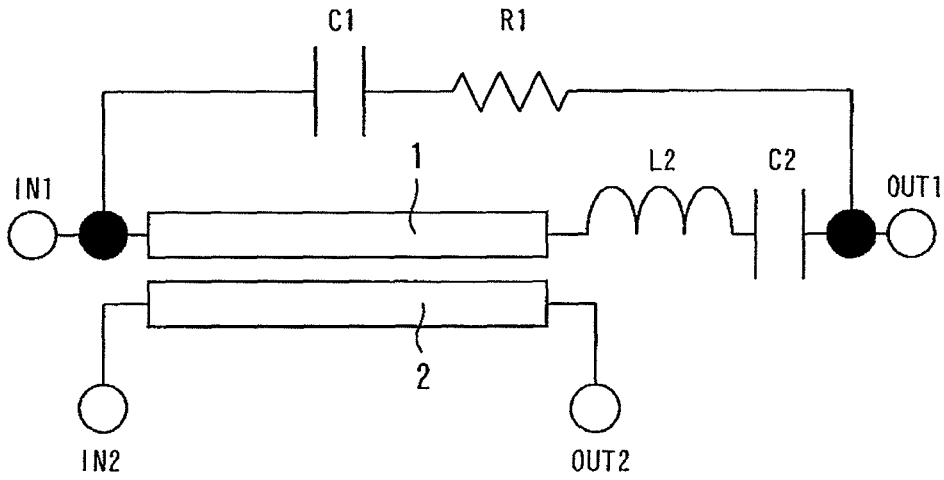
FIG. 21 is a diagram showing a modified example of the directional coupler according to the eighth embodiment of the present invention.

FIG. 21 is a diagram showing a modified example of the directional coupler according to the eighth embodiment of the present invention. The inductor L2 and the capacitor C2 of the fifth embodiment are added to the constitution of the modified example of the second embodiment. Thereby, the effect identical to the effect of the modified example of the second embodiment and the effect of the fifth embodiment can be obtained.

Ninth Embodiment

Figure 22:
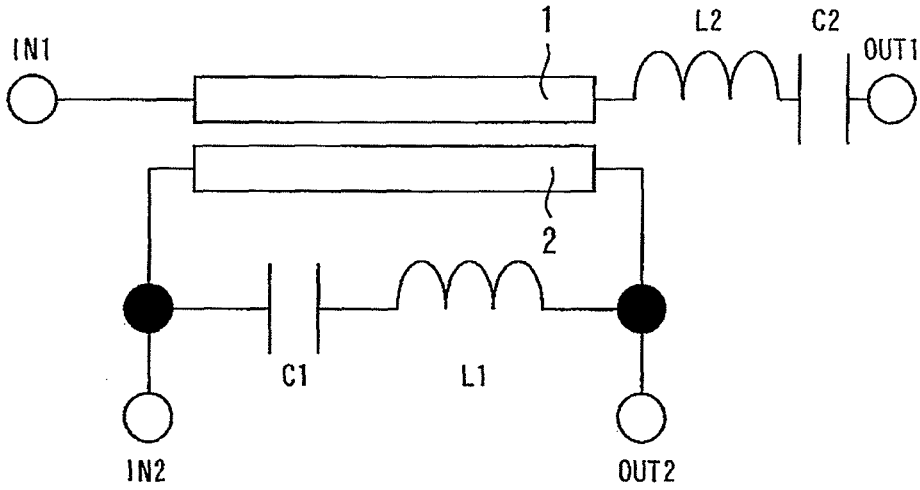
FIG. 22 is a diagram showing a directional coupler according to the ninth embodiment of the present invention.

FIG. 22 is a diagram showing a directional coupler according to the ninth embodiment of the present invention. The inductor L2 and the capacitor C2 of the fifth embodiment are added to the constitution of the third embodiment. Thereby, the effect identical to the effect of the third embodiment and the effect of the fifth embodiment can be obtained.

Figure 23:
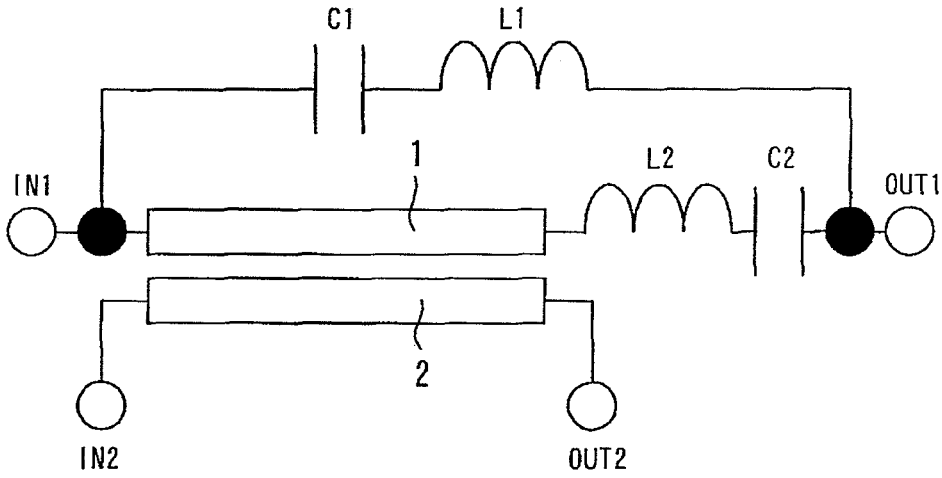
FIG. 23 is a diagram showing a modified example of the directional coupler according to the ninth embodiment of the present invention.

FIG. 23 is a diagram showing a modified example of the directional coupler according to the ninth embodiment of the present invention. The inductor L2 and the capacitor C2 of the fifth embodiment are added to the constitution of the modified example of the third embodiment. Thereby, the effect identical to the effect of the modified example of the third embodiment and the effect of the fifth embodiment can be obtained.

Obviously many modifications and variations of the present invention are possible in the light of the above teachings. It is therefore to be understood that within the scope of the appended claims the invention may be practiced otherwise than as specifically described.

The entire disclosure of a Japanese Patent Application No. 2010-253884, filed on Nov. 12, 2010 including specification, claims, drawings, and summary, on which the Convention priority of the present application is based, are incorporated herein by reference in its entirety.

What is claimed is:

1. A directional coupler comprising:

a main strip line connected between a first input terminal and a first output terminal and transmitting high-frequency signals;

a sub strip line connected between a second input terminal and a second output terminal, located parallel to the main strip line, and electromagnetically coupled to the main strip line; and a first capacitor and a resistor connected in series with the first capacitor, wherein the first capacitor and the resistor connected in series is connected in parallel with the main strip line or the sub strip line, an LC resonant circuit is constituted by inductances of the main strip line and the sub strip line and capacitance of the first capacitor, and the LC resonant circuit resonates with respect to a high-frequency signal propagating from the first input terminal to the second output terminal.

2. The directional coupler according to claim 1, further comprising an inductor connected in series with the main strip line.

3. The directional coupler according to claim 1, further comprising a second capacitor connected in series with the main strip line.

* * * * *